United States Patent [19]

Smith

[11] 4,117,655

[45] Oct. 3, 1978

[54] 2-FOR-1 TWISTER EQUIPPED WITH ANTIWRAPPING MEMBERS

[75] Inventor: Kenneth E. Smith, Bartlesville, Okla.

[73] Assignee: Phillips Petroleum Company, Bartlesville, Okla.

[21] Appl. No.: 775,501

[22] Filed: Mar. 8, 1977

[51] Int. Cl.[2] ..... D01H 7/86

[52] U.S. Cl. ..... 57/58.83; 57/156

[58] Field of Search ..... 57/58.49, 58.83, 58.86, 57/107, 156

[56] References Cited

U.S. PATENT DOCUMENTS

| | | | |
|---|---|---|---|
| 2,597,105 | 5/1952 | May | 57/58.83 |
| 2,625,786 | 1/1953 | Klein | 57/58.83 |
| 2,857,730 | 10/1958 | Vibber | 57/58.83 X |

*Primary Examiner*—Charles Gorenstein

[57] ABSTRACT

A 2-for-1 twister equipped with at least two antiwrapping members is effective to prevent entanglement of the yarn between the spindle and the spindle support means when the yarn breaks out immediately downstream of the twister.

7 Claims, 2 Drawing Figures

2-FOR-1 TWISTER EQUIPPED WITH ANTIWRAPPING MEMBERS

BACKGROUND OF THE INVENTION

The invention relates to a method and apparatus suitable for twisting a yarn. In another aspect the invention relates to a method and apparatus suitable for preventing a broken yarn from becoming entangled between the spindle and the spindle support means.

The use of synthetic yarns presently dominates the textile industry. Although some natural fibers such as cotton and wool are still used today, the majority of yarns used to produce clothing, carpeting, upholstery material and other textile goods are primarily synthetic yarns. In order for synthetic yarns to resemble yarns made from natural fibers, it is necessary to texture or bulk the synthetic yarns. Texturing synthetic yarns in order that such yarns when made into fabrics will have the hand and feel of fabrics made from natural staple yarns is well known in the art. The various texturing processes used to texture synthetic yarns also employ a variety of feed yarns. For example, a feed yarn can be drawn, partially drawn or undrawn and a feed yarn can be twisted or entangled to bind the filaments in the yarn closer together because a yarn that is not twisted or entangled often has filaments that become separated from the yarn that can snag and break during the various processing steps. Also packages of feed yarn should be used in a size or weight best suited for the particular process used. Some of the more commonly employed texturing processes use a feed yarn that has been twisted and drawn. To produce such a feed yarn, a draw-twist machine is frequently used. Such a machine, which is well known in the art, draws an as spun yarn and then twists the drawn yarn during windup by feeding the yarn to a rotating vertically mounted takeup bobbin through a rotatable "flyer" driven only by the angular momentum of the yarn. Although this type of machine works very well and is widely used, the packages of draw-twisted yarn that can be produced on such machines are relatively small because the windup bobbin itself must be rotated. In some texturing processes where large packages of feed yarn are desirable it is necesary to splice and recone the draw-twisted yarn to make larger feed yarn packages.

The problem of package size along with other disadvantages of the draw-twist process are overcome by use of the twist-draw process, that is, where the as spun yarn is twisted by a 2-for-1 twister and then drawn. In such a process the yarn is twisted prior to winding so that the types of winders employed are capable of winding much larger packages of yarn as compared to the takeup bobbin used on draw-twist machines.

One of the problems encountered with 2-for-1 twisters is that when the yarn breaks immediately downstream of the twister the yarn frequently becomes entangled between the spindle and the spindle support which results in costly down time of the equipment. Generally 2-for-1 twisters are equipped with a wrap guard which is usually a ring attached to the spindle that extends down over a portion of the spindle support means and thereby protects the bearings; however, experience has shown that while these wrap guards do provide some protection but that they are not entirely satisfactory. It has been found that a relatively simple modification to the 2-for-1 twister provides a substantial improvement in protecting the bearing from damage resulting from a broken yarn becoming entangled between the spindle and the spindle support means.

An object of the invention is to provide an improved 2-for-1 twister.

Another object of the invention is to improve the resistance of a 2-for-1 twister to bearing damage from broken yarns as compared with prior art 2-for-1 twisters.

Other aspects, objects and advantages will be apparent by studying the specification, drawings and the appended claims.

SUMMARY OF THE INVENTION

According to the invention a 2-for-1 twister comprises a spindle support means, a spindle having a yarn orifice, a yarn support means, and at least two antiwrap members, wherein the spindle is rotatably connected to the spindle support means and forms an intersection therewith, the yarn support means is connected to the spindle above the yarn orifice, and the antiwrap members are positioned adjacent the intersection of the spindle and the spindle support means and equally spaced around the spindle.

Further according to the invention entanglement of a yarn being twisted on a 2-for-1 twister between the spindle and the spindle support means is prevented when the yarn breaks out downstream of the 2-for-1 twister by holding at least a substantial portion of each of the wraps of the broken yarns surrounding the spindle away from the intersection of the spindle and the spindle support means. Such a method and apparatus provide a substantial improvement in the prevention of damage caused by a broken yarn wrapping around the spindle between the spindle and the spindle support means as compared to 2-for-1 twisters known in the prior art.

DETAILED DESCRIPTION OF THE INVENTION

Figure 1:
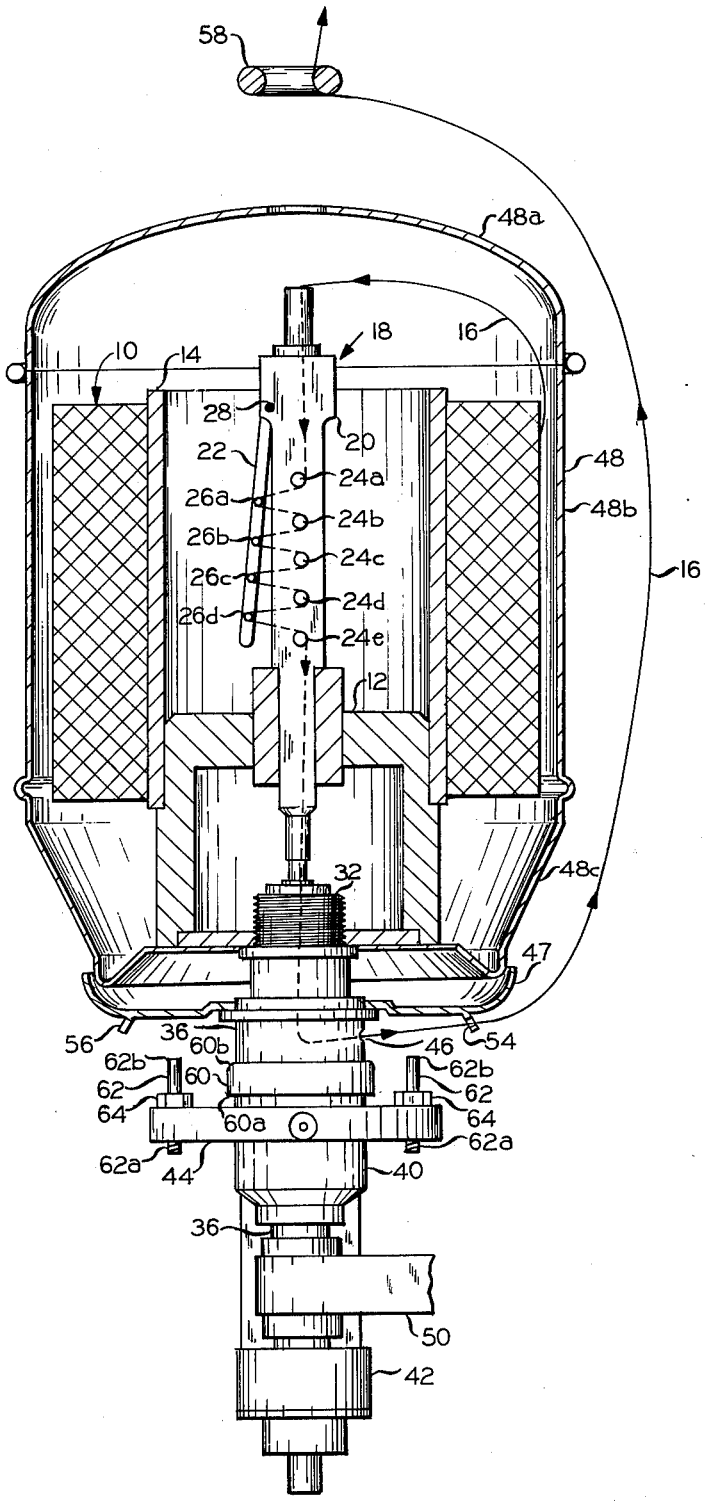
FIG. 1 is an illustration of one embodiment of a 2 for-1 twister in accordance with the invention.

In FIG. 1 of the drawing a package of yarn represented generally by reference numeral 10 is supported on package support means 12. The package of yarn comprises a package support 14 and the yarn 16. A tension means represented generally by reference numberal 18 is positioned inside the package support and comprises a fixed member 20 and a movable member 22 although various other tension means known in the art can be employed. Fixed member 20 is a tube and has yarn guides 24*a, b, c, d* and *e* positioned inside the tube. Movable member 22 has yarn guides 26*a, b, c* and *d* and movable member 22 is hinged to fixed member 20 by pin 28. A spring (not shown) is coiled around pin 28 in a counterclockwise direction so as to force movable member 22 out away from fixed member 20. Yarn guides 26*a*, 26*b*, 26*c* and 26*d* are staggered between yarn guides 24*a*, 24*b*, 24*c*, 24*d* and 24*e* so as to provide substantially a sinusoidal yarn path.

Figure 2:
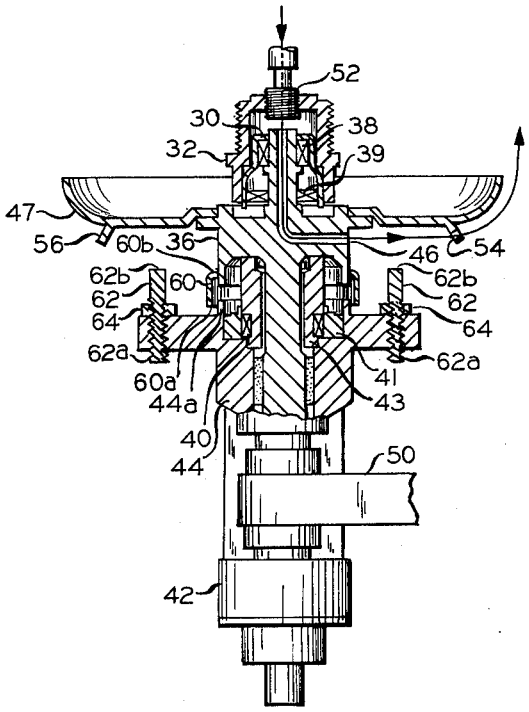
FIG. 2 shows the lower portion of the apparatus shown in FIG. 1.

Spindle 36 extends to approximately the top of flange 32 and through bearings 38, 39, 40, and 42 shown more clearly in FIG. 2. Bearings 40 and 42 are a part of spindle support means 44 which does not rotate. Spindle 36 has a yarn outlet orifice 46 and yarn support means, such as disc 47, which is connected to spindle 36 just above yarn outlet orifice 46. A container 48 surrounds yarn package 10 and comprises a top portion 48*a*, a middle portion 48*b* and a bottom portion 48*c*. Bottom portion 48*c* is supported on threaded member 30 and flange 32 which do not rotate. Since spindle support means 44 does not rotate, additional support to rotating spindle 36 is obtained through spacer ring 41, bearing 40 and ring 43. A suitable power means (not shown) is used to turn spindle 36 via belt 50.

A wrap guard, such as ring 60, has an upper portion 60*b* and a lower portion 60*a*, has the upper portion 60*b* attached to spindle 36, seen more clearly in FIG. 2, and has the lower portion surrounding a portion 44*a* of the spindle support means 44. In accordance with the present invention at least two antiwrap members, such as antiwrap pins 62, each having a bottom 62*a* and a top 62*b* are attached to the spindle support means 44. Three, four or more antiwrap members can be employed if desired. Spindle 36 and spindle support means 44 form an intersection near the bottom 60*a* of ring 60. The antiwrap pins 62 are positioned adjacent the intersection of the spindle 36 and the spindle support means 44. As shown in the drawing, the bottom 62*a* of antiwrap pins 62 is threaded which is screwed into spindle support means 44 up to nut 64. Although it is not essential to attach pins 62 to spindle support means 44, it is generally a convenient means of placing pins 62 in the proper position, i.e., adjacent the intersection of spindle 36 and spindle support means 44. Nut 64 can be fastened to antiwrap pins 62 by any suitable manner, such as welding. The top 62*b* of antiwrap pins 62 is substantially lower than the bottom of disc 47 so that they will not catch yarn 16 exiting opening 46 in spindle 36 and is substantially above the lower portion 60*a* of wrap guard 60. Generally the tops 62*b* of the antiwrap members, such as antiwrap pins 62 are positioned approximately at the same height with respect to the spindle as the upper portion 60*b* of wrap guard, ring 60. Also the antiwrap members are generally equally spaced around spindle 36.

In the operation of the apparatus yarn 16 is passed to the top of fixed member 20 of tension device 18 as a tensioning zone. Yarn 16 is passed through tension means 18 as shown in FIG. 1. Yarn 16 is passed through the threaded end 52 of fixed member 20 of tension device 18 and into spindle 36 as shown by the dashed line and out of spindle 36 through yarn orifice 46. Yarn 16 passes through ceramic eyelet 54 in skirt 56 of disc 48. Yarn 16 forms a "balloon" around container 48 and the yarn 16 is then passed through a guide 58 positioned above the top portion 48*a* of container 48.

When yarn 16 breaks out downstream of orifice 46 the yarn will wrap around antiwrap pins 62 surrounding spindle 36 and at least a substantial portion of each of the wraps of the broken yarn surrounding spindle 56 will be held away from the intersection of the spindle 36 and the spindle support means 44. When only two antiwrap members are employed, such as shown in FIGS. 1 and 2, the yarn wrapped around pins 62 will touch against ring 60, but the yarn will not be able to work its way up between the bottom portion 60*a* of ring 60 and portion 44*a* spindle support means 44 and possibly into bearing 40. If three, four or more antiwrap members are employed it is possible to prevent the wraps of broken yarn from touching against ring 60, but it has been found that two antiwrap members, such as antiwrap pins 62 are satisfactory to prevent yarn from becoming entangled between spindle 36 and spindle support means 44.

EXAMPLE

In accordance with the invention, a 2-for-1 twister manufactured by Verdol, VDL 1515 22-G, Lyon, France and equipped with a Stehedco Model 2004 UTC tension device manufactured by the Steel Heddle Co. of Greenville, S.C., was modified by adding two ⅜-inch (0.952 cm) diameter pins to the existing holes in the spindle support means 44 as shown in FIG. 1. The pins were threaded on their lower ends with a nut welded to the pin at the top of the threads. The center of the pins each measured 1.937 inches (4.921 cm) from the center of the spindle. The portion extending above the base had a smooth outside surface and extended above the wrap guard 0.187 inch (0.476 cm) similar to bearing protection ring 60 as shown in FIGS. 1 and 2, or approximately 1 inch (2.54 cm) above the base.

During operation of equipment fitted with the above-described 2-for-1 twister, the feed yarn was polypropylene 1750 denier, 70 filament yarn. The 2-for-1 twister was operated at 4000 RPM and the linear speed of the yarn was 145 meters per minute. The yarn broke immediately downstream of the twister numerous times; however, yarn was prevented from entering the bearings by the antiwrap pins which captured the yarn surrounding the spindle when the yarn broke and held at least a portion of each of the yarn wraps away from the intersection of the spindle and the spindle support. The above results are to be compared with the results obtained with the antiwrap pins removed, but with the wrap guard in place. In those runs the broken yarn frequently became entangled between the spindle and the spindle support at the intersection of those two parts, causing costly down time of the equipment to remove the yarn and repair the equipment. The above comparison clearly demonstrates the surprising results obtained employing the apparatus of the present invention.

That which is claimed is:

1. A 2-for-1 twister comprising spindle support means, spindle having a yarn orifice, yarn support means, and at least two antiwrap members, wherein said spindle is rotatably connected to said spindle support means and forms an intersection therewith adjacent and immediately below said yarn orifice, said yarn support means is connected to said spindle above said yarn orifice, and said antiwrap members are positioned adjacent said intersection of the spindle and the spindle support means and equally spaced around said spindle so that the antiwrap members receive wraps of a yarn fed from the spindle upon breakage of the yarn and the wraps of yarn are held out of the intersection of the spindle and the spindle support means.

2. The 2-for-1 twister of claim 1 wherein the antiwrap members are antiwrap pins.

3. A 2-for-1 twister comprising spindle support means, spindle having a yarn orifice, yarn support means, at least two antiwrap members, and a wrap guard, wherein said spindle is rotatably connected to said spindle support means and forms an intersection therewith, said yarn support means is connected to said spindle above said yarn orifice, and said antiwrap members are positioned adjacent said intersection of the spindle and the spindle support means and equally spaced around said spindle, and wherein the wrap guard has an upper portion and a lower portion, said upper portion of said wrap guard being attached to said spindle below said yarn support means and said lower portion of said wrap guard surrounding a portion of said spindle support means, and said wrap members being positioned so that the tops of said antiwrap members extend substantially above the lower portion of said wrap guard.

4. The 2-for-1 twister of claim 3 further comprising a tension means and a package support means, said package support means being rotatably connected to said spindle and positioned above said yarn support means, and said tension means being attached to said package support means.

5. The 2-for-1 twister of claim 3 wherein the tops of the antiwrap members are positioned approximately at the same height with respect to the spindle as the upper portion of the wrap guard.

6. A method for preventing entanglement of a yarn between the spindle and the spindle support means of a 2-for-1 twister when the yarn being twisted on the 2-for-1 twister breaks downstream of said 2-for-1 twister in a manner to form wraps of broken yarn around the spindle by wrapping the broken yarn around at least two antiwrap members positioned adjacent the intersection of the spindle and the spindle support means.

7. A method according to claim 6 wherein the at least two antiwrap members are equally spaced around said intersection.

* * * * *